US011993862B2

(12) United States Patent
Hatabe et al.

(10) Patent No.: US 11,993,862 B2
(45) Date of Patent: May 28, 2024

(54) STRUCTURE INCLUDING COPPER PLATING LAYER OR COPPER ALLOY PLATING LAYER

(71) Applicant: ISHIHARA CHEMICAL CO., LTD., Kobe (JP)

(72) Inventors: Masaru Hatabe, Kobe (JP); Hironori Murakami, Kobe (JP); Fuka Yamaoka, Kobe (JP)

(73) Assignee: ISHIHARA CHEMICAL CO., LTD., Kobe (JP)

( * ) Notice: Subject to any disclaimer, the term of this patent is extended or adjusted under 35 U.S.C. 154(b) by 236 days.

(21) Appl. No.: 17/595,032

(22) PCT Filed: Apr. 30, 2020

(86) PCT No.: PCT/JP2020/018233

§ 371 (c)(1),
(2) Date: Nov. 5, 2021

(87) PCT Pub. No.: WO2020/226116

PCT Pub. Date: Nov. 12, 2020

(65) Prior Publication Data

US 2022/0316085 A1 Oct. 6, 2022

(30) Foreign Application Priority Data

May 8, 2019 (JP) ..... 2019-088289

(51) Int. Cl.
*C25D 21/12* (2006.01)
*C25D 3/38* (2006.01)
*C25D 5/18* (2006.01)

(52) U.S. Cl.
CPC ..... *C25D 21/12* (2013.01); *C25D 3/38* (2013.01); *C25D 5/18* (2013.01); *Y10T 428/1291* (2015.01)

(58) Field of Classification Search
None
See application file for complete search history.

(56) References Cited

U.S. PATENT DOCUMENTS

| | | | | | |
|---|---|---|---|---|---|
| 5,069,979 | A * | 12/1991 | Nakajima | C25D 5/10 | 428/647 |
| 6,319,385 | B1 * | 11/2001 | Mull | C25D 5/605 | 205/112 |
| 8,500,983 | B2 * | 8/2013 | Ponnuswamy | C25D 7/123 | 205/104 |
| 2007/0240993 | A1 * | 10/2007 | Nakato | C25D 3/56 | 204/229.4 |
| 2011/0001250 | A1 * | 1/2011 | Lin | H01L 24/81 | 427/97.1 |

FOREIGN PATENT DOCUMENTS

| | | | |
|---|---|---|---|
| JP | 2004-154845 | A | 6/2004 |
| JP | 2008-308749 | A | 12/2008 |
| JP | 2008308749 | A * | 12/2008 |
| JP | 5756140 | B2 | 7/2015 |

OTHER PUBLICATIONS

International Search Report dated Jul. 7, 2020 in International Application No. PCT/JP2020/018233.

* cited by examiner

*Primary Examiner* — Seth Dumbris
(74) *Attorney, Agent, or Firm* — Knobbe, Martens, Olson & Bear, LLP

(57) ABSTRACT

A structure includes a copper or copper alloy plating layer, in which Kirkendall void formation is suppressed. The copper or copper alloy plating layer is formed by electroplating at a prescribed first cathode current density by using a copper or copper alloy electroplating bath and then completing the electroplating after the first cathode current density is changed to a lower second cathode current density. The first cathode current density is a single cathode current density in the electroplating at this current density or an average cathode current density in the electroplating by combining plural cathode current densities. The first cathode current density is at lowest 5 A/dm$^2$. A layer formed by changing the first cathode current density to the second cathode current density is a surface layer part of the copper or copper alloy plating layer, which can have a thickness of 0.05 μm to 15 μm.

7 Claims, No Drawings

STRUCTURE INCLUDING COPPER PLATING LAYER OR COPPER ALLOY PLATING LAYER

PRIORITY AND CROSS REFERENCE TO RELATED APPLICATIONS

This application is the U.S. National Stage Application under 35 U.S.C. § 371 of International Application No. PCT/JP2020/018233, filed Apr. 30, 2020, designating the U.S. and published as WO 2020/226116 A1 on Nov. 12, 2020, which claims the benefit of Japanese Application No. JP 2019-088289, filed May 8, 2019. Any and all applications for which a foreign or a domestic priority is claimed is/are identified in the Application Data Sheet filed herewith and is/are hereby incorporated by reference in their entirety under 37 C.F.R. § 1.57.

TECHNICAL FIELD

The present invention relates to a structure including copper plating layers or copper alloy plating layers. The present invention specifically relates to a structure including a copper plating layer or a copper alloy plating layer, which can be produced without any complicated steps while a Kirkendall void (void) is suppressed from being formed.

BACKGROUND ART

In general, an electrode of an electronic component and another component are bonded with each other by solder plating, solder ball, solder paste, or the like. For example, when a semiconductor chip adopts bump electrodes (Copper Pillars) in order to improve its electrical characteristics and/or to be compatible with fine pitch, a Cu/Ni/Sn—Ag-based structure, a Cu/Ni/Sn-based structure, or the like is formed by a plating step. Further, many Cu/Sn—Ag-based structures are recently available in which Ni layers are omitted in order to prevent complication and/or increase in cost of production processes.

At a bonding interface between Cu and Sn or an Sn alloy, however, a difference in diffusion speed among these metals may form a Kirkendall void, which may lead to a problem that a resultant structure has a reduced reliability.

Thus, in order to suppress such a Kirkendall void from being formed at the bonding interface between metals, for example, techniques disclosed in Patent Literatures 1 and 2 have been proposed.

Patent Literature 1 discloses a technique of adding, to tin as a main material, silver, copper, phosphorus, antimony, bismuth, and the like so as to suppress an intermetallic compound from being formed at an interface between a copper pillar and a tin alloy, thereby suppressing the Kirkendall void from being formed.

Patent Literature 2 discloses a technique of forming, on a copper-containing pillar layer, a diffusion barrier layer containing nickel, nickel-phosphorus, nickel-vanadium, or the like, thereby suppressing the Kirkendall void from being formed.

Controlling a complicated metal composition as described in connection with the technique disclosed in Patent Literature 1 is, however, practically impossible in recently available plating methods. In contrast, adopting the technique disclosed in Patent Literature 2 results in a problem that steps become too complicated, and such a technique cannot be adopted in many cases from the aspect of cost.

CITATION LIST

Patent Literature

[Patent Literature 1] Japanese Laid-Open Patent Publication No. 2004-154845

[Patent Literature 2] Japanese Patent No. 5756140

SUMMARY OF INVENTION

An object of the present invention is to provide a structure which includes a plating layer containing copper and which can be produced without any complicated step while a Kirkendall void is suppressed from being formed.

The present invention (I) relates to a structure including a copper plating layer or a copper alloy plating layer, wherein the copper plating layer or the copper alloy plating layer is a plating layer which is formed by:

performing an electroplating process at a prescribed first cathode current density by using a copper or copper alloy electroplating bath; and then completing the electroplating process after the prescribed first cathode current density is changed to a second cathode current density which is lower than the prescribed first cathode current density, the prescribed first cathode current density is a single cathode current density in the electroplating process which is performed at the single cathode current density until the first cathode current density is changed to the second cathode current density, the prescribed first cathode current density is greater than or equal to 5 A/dm$^2$, a layer which is formed by changing the prescribed first cathode current density to the second cathode current density is a surface layer part of the copper plating layer or the copper alloy plating layer, and the surface layer part has a thickness in the range from 0.05 μm to 15 μm.

The present invention (II) relates to a structure including a copper plating layer or a copper alloy plating layer, wherein the copper plating layer or the copper alloy plating layer is a plating layer which is formed by:

performing an electroplating process at a prescribed first cathode current density by using a copper or copper alloy electroplating bath; and then completing the electroplating process after the prescribed first cathode current density is changed to a second cathode current density which is lower than the prescribed first cathode current density, the prescribed first cathode current density is an average cathode current density in the electroplating process which is performed by combining a plurality of cathode current densities until the first cathode current density is changed to the second cathode current density, the average cathode current density is calculated in accordance with a formula (1):

Average Cathode Current Density $$=[\text{Cathode current density}]_{n1}\times([\text{Plating time}]_{n1}/\text{Total plating time})+[\text{Cathode current density}]_{n2}\times([\text{Plating time}]_{n2}/\text{Total plating time})\ldots\ldots+[\text{Cathode current density}]_{n-1}\times([\text{Plating time}]_{n-1}/\text{Total plating time})+[\text{Cathode current density}]_{n}\times([\text{Plating time}]_{n}/\text{Total plating time}) \quad (1)$$

in which the plurality of cathode current densities are n cathode current densities,

[Cathode current density]$_{n1}$ is a 1$^{st}$ cathode current density,

[Cathode current density]$_{n2}$ is a 2$^{nd}$ cathode current density, . . . . . .

[Cathode current density]$_{n-1}$ is an (n−1)$^{th}$ cathode current density,

[Cathode current density]$_{n}$ is an n$^{th}$ cathode current density,

[Plating time]$_{n1}$ is a time of plating performed at [Cathode current density]$_{n1}$,

[Plating time]$_{n2}$ is a time of plating performed at [Cathode current density]$_{n2}$, . . . . . .

[Plating time]$_{n-1}$ is a time of plating performed at [Cathode current density]$_{n-1}$, and

[Plating time]$_{n}$ is a time of plating performed at [Cathode current density]$_{n}$, the prescribed first cathode current density is greater than or equal to 5 A/dm$^2$, a layer which is formed by changing the prescribed first cathode current density to the second cathode current density is a surface layer part of the copper plating layer or the copper alloy plating layer, and the surface layer part has a thickness in the range from 0.05 μm to 15 μm.

In the present invention (II), it is preferred that in a time period from a start of the electroplating process which is performed by combining the plurality of cathode current densities to a final stage in which the copper plating layer or the copper alloy plating layer is formed, the electroplating process which is performed by combining the plurality of cathode current densities is:

an electroplating process which is performed by sequentially increasing the cathode current densities; or an electroplating process including a process which is performed by increasing one of the cathode current densities and then, lowering an increased cathode current density.

The structure including a copper plating layer or a copper alloy plating layer of the present invention can be produced without any complicated steps while a Kirkendall void is satisfactorily suppressed from being formed and thus provides high reliability.

DETAILED DESCRIPTION

Each of the structure of the present invention (I) and the structure of the present invention (II) includes a copper plating layer or a copper alloy plating layer. The copper plating layer or the copper alloy plating layer is formed by: performing an electroplating process at a prescribed first cathode current density by using a copper or copper alloy electroplating bath; and then, completing the electroplating process after the prescribed first cathode current density is changed to a second cathode current density which is lower than the prescribed first cathode current density. Note that in the present specification, the present invention (I) and the present invention (II) are collectively referred to also as "the present invention", and the structure of the present invention (I) and the structure of the present invention (II) are collectively referred to also as "the structure of the present invention".

The copper or copper alloy electroplating bath preferably contains, for example, one or more copper ion-supplying compounds.

The copper ion-supplying compound is not particularly limited and may be a copper soluble salt producing $Cu^{2+}$ basically in an aqueous solution. Examples of the copper ion-supplying compound include: a copper carboxylic acid salt such as copper acetate, copper oxalate, and copper citrate; a copper alkylsulfonic acid salt such as copper methanesulfonate and copper hydroxyethanesulfonate; and the like in addition to copper sulfate, copper oxide, copper nitrate, copper chloride, copper pyrophosphate, and copper carbonate. Among these compounds, one or more compounds may be used as the copper ion-supplying compound.

A content of the copper ion-supplying compound in the copper electroplating bath is not particularly limited. The content is preferably in the range from about 1 g/L to about 300 g/L, more preferably in the range from about 30 g/L to about 250 g/L.

When the plating bath used for the electroplating process is the copper electroplating bath, at least the copper ion-supplying compound is contained, whereas when the plating bath used for the electroplating process is the copper alloy electroplating bath, at least one soluble salt of metal producing an alloy together with copper are also contained.

The metal producing an alloy together with copper is not particularly limited. Examples of the metal include nickel, silver, zinc, bismuth, cobalt, indium, antimony, tin, gold, and lead. Note that as described later, when the structure of the present invention includes a plating layer of metal or a metal alloy other than copper adjacently to the copper alloy plating layer, the metal producing an alloy together with copper is at least one selected from metals which do not constitute the plating layer of metal or a metal alloy other than copper.

Examples of a soluble salt of nickel include nickel sulfate, nickel formate, nickel chloride, nickel sulfamate, nickel borofluoride, nickel acetate, nickel methanesulfonate, and nickel 2-hydroxypropanesulfonate.

Examples of a soluble salt of silver include silver carbonate, silver nitrate, silver acetate, silver chloride, silver oxide, silver cyanide, potassium silver cyanide, silver methanesulfonate, silver 2-hydroxyethanesulfonate, and silver 2-hydroxypropanesulfonate.

Examples of a soluble salt of zinc include zinc oxide, zinc sulfate, zinc nitrate, zinc chloride, zinc pyrophosphate, zinc cyanide, zinc methanesulfonate, zinc 2-hydroxyethanesulfonate, and zinc 2-hydroxypropanesulfonate.

Examples of a soluble salt of bismuth include bismuth sulfate, bismuth gluconate, bismuth nitrate, bismuth oxide, bismuth carbonate, bismuth chloride, bismuth methanesulfonate, and bismuth 2-hydroxypropanesulfonate.

Examples of a soluble salt of cobalt include cobalt sulfate, cobalt chloride, cobalt acetate, cobalt borofluoride, cobalt methanesulfonate, and cobalt 2-hydroxypropanesulfonate.

Examples of a soluble salt of indium include indium sulfamate, indium sulfate, indium borofluoride, indium oxide, indium methanesulfonate, and indium 2-hydroxypropanesulfonate.

Examples of a soluble salt of antimony include antimony borofluoride, antimony chloride, potassium antimonyl tartrate, potassium pyroantimonate, antimony tartrate, antimony methanesulfonate, and antimony 2-hydroxypropanesulfonate.

Examples of a soluble salt of tin include stannous sulfate, stannous acetate, stannous borofluoride, stannous sulfamate, stannous pyrophosphate, stannous chloride, stannous gluconate, stannous tartrate, stannous oxide, sodium stannate, potassium stannate, stannous methanesulfonate, stannous ethanesulfonate, stannous 2-hydroxyethanesulfonate, stannous 2-hydroxypropanesulfonate, and stannous sulfosuccinate.

Examples of a soluble salt of gold include potassium chloroaurate, sodium chloroaurate, ammonium chloroaurate, potassium gold sulfite, sodium gold sulfite, ammonium gold sulfite, potassium gold thiosulfate, sodium gold thiosulfate, and ammonium gold thiosulfate.

Examples of a soluble salt of lead include lead acetate, lead nitrate, lead carbonate, lead borofluoride, lead sulfamate, lead methanesulfonate, lead ethanesulfonate, lead 2-hydroxyethanesulfonate, and lead 2-hydroxypropanesulfonate.

A total content of the copper ion-supplying compound and the soluble salt of metal producing an alloy together with copper in the copper alloy electroplating bath is not particularly limited. The total content is preferably in the range from about 1 g/L to about 200 g/L, more preferably in the range from about 10 g/L to about 50 g/L.

A combination and a ratio of the copper ion-supplying compound and the soluble salt of metal producing an alloy together with copper are not particularly limited. The combination and the ratio of both compounds may be suitably adjusted such that the structure of the present invention, which is formed from the copper alloy electroplating bath, has a desired composition.

The copper or copper alloy electroplating bath may contain, for example, various additives such as an electrolyte, an accelerator, a high molecular surfactant, a leveler, a pH buffer agent, and a chelating agent in addition to the one or more copper ion-supplying compounds and the one or more soluble salts of metal producing an alloy together with copper.

Examples of the electrolyte include an acid, a chloride, a nitrate, a sulfate, a carbonate, a phosphate, an acetate, and a perchlorate.

Examples of the acid include nitric acid, hydrochloric acid, sulfuric acid, methanesulfonic acid, acetic acid, carbonic acid, phosphoric acid, boric acid, oxalic acid, lactic acid, hydrogen sulfide, hydrofluoric acid, formic acid, perchloric acid, chloric acid, chlorous acid, hypochlorous acid, hydrobromic acid, hydriodic acid, nitrous acid, and sulfurous acid. Note that hydrochloric acid acts also as a chloride ion-supplying source.

The chloride acts as the chloride ion-supplying source in the same manner as in hydrochloric acid. Examples of the chloride include lithium chloride, sodium chloride, potassium chloride, magnesium chloride, calcium chloride, barium chloride, zinc chloride copper(II) chloride, aluminum chloride, iron(III) chloride, and ammonium chloride.

Examples of the nitrate include sodium nitrate, potassium nitrate, magnesium nitrate, calcium nitrate, barium nitrate, zinc nitrate, silver nitrate, copper(II) nitrate, aluminum nitrate, iron(III) nitrate, and ammonium nitrate. Note that among these nitrates, copper(II) nitrate acts also as the copper ion-supplying compound, and zinc nitrate and silver nitrate act also as the soluble salts of metal producing an alloy together with copper.

Examples of the carbonate include sodium carbonate, sodium hydrogen carbonate, potassium carbonate, potassium hydrogen carbonate, and ammonium carbonate.

Examples of the phosphate include sodium phosphate, disodium hydrogen phosphate, sodium hydrogen phosphate, potassium phosphate, dipotassium hydrogen phosphate, and potassium hydrogen phosphate.

Examples of the acetate include sodium acetate, potassium acetate, calcium acetate, copper(II) acetate, aluminum acetate, and ammonium acetate.

Examples of the perchlorate include sodium perchlorate and potassium perchlorate.

The accelerator is a component which prompts generation of growth nuclei in plating precipitation. Examples of the accelerator include bis(3-sulfopropyl)disulfide (also called 3,3'-dithiobis(1-propanesulfonic acid)), bis(2-sulfopropyl) disulfide, bis(3-sulfo-2-hydroxypropyl)disulfide, bis(4-sulfopropyl)disulfide, bis(p-sulfophenyl)disulfide, 3-benzothiazolyl-2-thio propanesulfonic acid, N,N-dimethyldithiocarbamyl propanesulfonic acid, N,N-dimethyldithiocarbamyl propanesulfonic acid, N,N-dimethyldithiocarbamic acid-(3-sulfopropyl)-ester, 3-[(aminoiminomethyl)thio]-1-propanesulfonic acid, o-ethyl-diethyl carbonic acid-S-(3-sulfopropyl)ester, mercaptomethanesulfonic acid, mercaptoethanesulfonic acid, mercaptopropanesulfonic acid, and a salt thereof.

As the high molecular surfactant, a nonionic surfactant is particularly preferable. Examples of the high molecular surfactant include polyethylene glycol, polypropylene glycol, a Pluronic (Registered Trademark) type surfactant, a Tetronic type surfactant, polyethylene glycol·glyceryl ether, sulfonic acid group-containing polyalkylene oxide addition type amines, and a nonionic polyether type high molecular surfactant such as polyoxyethylene alkyl ether, bisphenol A polyethoxylate, and alkyl naphthalene sodium sulfonate.

The leveler (smoothing agent) has a function of suppressing electrodeposition and exhibits effect for smoothing an electrodeposition coating. The leveler is preferably selected from, for example, amines, a dye, imidazolines, imidazoles, benzimidazoles, indoles, pyridines, quinolines, isoquinolines, anilines, and aminocarboxylic acids.

The amines are preferably sulfonic acid group-containing alkylene oxide addition type amines. The sulfonic acid group-containing alkylene oxide addition type amines are classified into the high molecular surfactant because alkylene oxide(s) is(are) added thereto, and may be classified into also the amines and are effective as the leveler.

Specific examples of a nitrogen-containing organic compound other than the amines, which is effective as the leveler, include: a toluidine dye such as Color Index (hereinafter referred to as "C.I.") basic red 2 and toluidine blue: an azo dye such as C.I. direct yellow 1 and C.I. basic black 2; a phenazine dye such as 3-amino-6-dimethylamino-2-methylphenazine monohydrochloride; polyethylenimine; a copolymer of diallylamine and allylguanidine methanesulfonate; EO and/or PO adducts of tetramethylethylenediamine; succinimide; imidazolines such as 2'-bis(2-imidazoline); imidazoles; benzimidazoles; indoles; pyridines such as 2-vinylpyridine, 4-acetylpyridine, 4-mercapto-2-carboxylpyridine, 2,2'-bipyridyl, and phenanthroline; quinolines; isoquinolines; anilines; 3,3',3"-nitrilotripropionic acid; and diaminomethyleneaminoacetic acid. Among them, there are preferred the toluidine dye such as C.I. basic red 2; the azo dye such as C.I. direct yellow 1; the phenazine dye such as 3-amino-6-dimethylamino-2-methylphenazine monohydrochloride; polyethylenimine; the copolymer of diallylamine and allylguanidine methanesulfonate; the EO and PO adducts of tetramethylethylenediamine; the imidazolines such as 2'-bis(2-imidazoline); the benzimidazoles; the pyridines such as 2-vinylpyridine, 4-acetylpyridine, 2,2'-bipyridyl, and phenanthroline; the quinolines; the anilines; 3,3',3"-nitrilotripropionic acid; and aminocarboxylic acids such as aminomethyleneaminoacetic acid.

Examples of the pH buffer agent include a monocarboxylic acid such as formic acid, acetic acid, and propionic acid; a dicarboxylic acid such as boric acids, phosphoric acids, oxalic acid, and succinic acid; an oxycarboxylic acid such as lactic acid, tartaric acid, citric acid, malic acid, and isocitric acid; and an oxo acid such as boric acid, metaboric acid, and tetraboric acid. Some of these examples overlap examples of the acid as the electrolyte.

Examples of the chelating agent include an oxycarboxylic acid, a polycarboxylic acid, and a monocarboxylic acid, and some of these examples overlap the examples of the acid as the electrolyte and the pH buffer agent. Examples of the chelating agent specifically include gluconic acid, citric acid, glucoheptonic acid, gluconolactone, glucoheptolactone, formic acid, acetic acid, propionic acid, butyric acid, ascorbic acid, oxalic acid, malonic acid, succinic acid, glycolic acid, malic acid, tartaric acid, diglycolic acid, and salt thereof. Further examples of the chelating agent include ethylene diamine, ethylenediaminetetraacetic acid (EDTA), diethylenetriaminepentaacetic acid (DTPA), nitrilotriacetic acid (NTA), iminodiacetic acid (IDA), iminodipropionic acid (IDP), hydroxyethyl ethylenediaminetetraacetic acid (HEDTA), triethylene tetraminehexaacetic acid (TTHA), ethylenedioxybis(ethylamine)-N,N,N',N'-tetraacetic acid, glycines, nitrilotrimethyl phosphonic acid, 1-hydroxyethane-1,1-diphosphonic acid, and salt thereof.

A content of each of the various additives in the copper or copper alloy electroplating bath is not particularly limited. The content is at least suitably adjusted such that intended structure is formed from the plating bath.

The copper or copper alloy electroplating bath can be initially made by, for example, suitably combining: the one or more copper ion-supplying compounds; the one or more soluble salts of metal producing an alloy together with copper; the various additives such as the electrolyte, the accelerator, the high molecular surfactant, the leveler, the pH buffer agent, and the chelating agent; and the like.

The copper plating layer or the copper alloy plating layer constituting the structure of the present invention may be formed by performing an electroplating process by using the copper or copper alloy electroplating bath, and the electroplating process has a significant feature. That is, the electroplating process is performed at a prescribed first cathode current density by using the copper or copper alloy electroplating bath, and then, the electroplating process is completed after the prescribed first cathode current density is changed to a second cathode current density which is lower than the prescribed first cathode current density, thereby forming the copper plating layer or the copper alloy plating layer. Thus, because the electroplating process is completed at the cathode current density which is lower than the preceding cathode current density prior to completion of the electroplating process, at the bonding interface between: the copper plating layer or the copper alloy plating layer; and, for example, a plating layer of metal or a metal alloy other than copper (which will be described later), the Kirkendall void which will be formed due to a difference in diffusion speed between the metals can be suppressed from being formed.

Note that the prescribed first cathode current density is changed to the second cathode current density which is lower than the prescribed first cathode current density at a final stage in which the copper plating layer or the copper alloy plating layer is formed. The final stage is a stage for forming a surface layer part of the copper plating layer or the copper alloy plating layer.

As to the structure of the present invention (I), the prescribed first cathode current density is a single cathode current density in the electroplating process which is performed at the single cathode current density until the first cathode current density is changed to the second cathode current density.

The electroplating process which is performed at the single cathode current density is an electroplating process in which a starting cathode current density is set as the first cathode current density and is maintained. That is, after the electroplating process is started at the prescribed first cathode current density, the prescribed first cathode current density is lowered for the first time at the final stage in which the copper plating layer or the copper alloy plating layer is formed. A cathode current density thus lowered is the second cathode current density.

As to the structure of the present invention (II), the prescribed first cathode current density is an average cathode current density in the electroplating process which is performed by combining a plurality of cathode current densities until the first cathode current density is changed to the second cathode current density.

The electroplating process which is performed by combining the plurality of cathode current densities is an electroplating process in which a cathode current density among the plurality of cathode current densities is changed at least one time in a time period from a start of the electroplating process to the final stage in which the copper plating layer or the copper alloy plating layer is formed.

That is, as to the present invention (II), in the time period from the start to the final stage, the cathode current density among the plurality of cathode current densities may be changed any number of times to a higher or lower cathode current density than the preceding cathode current density. Examples of such an electroplating process which is performed by combining the plurality of cathode current densities in the time period from the start to the final stage include: an electroplating process which is performed by sequentially increasing the cathode current densities in the time period; an electroplating process which is performed by sequentially lowering the cathode current densities in the time period; an electroplating process including a process which is performed by increasing one of the cathode current densities and then, lowering an increased cathode current density in the time period; and an electroplating process including a process which is performed by lowering one of the cathode current densities and then, increasing a lowered cathode current density in the time period. Among the electroplating processes each of which is performed by combining the plurality of cathode current densities, the electroplating process which is performed by sequentially increasing the cathode current densities and the electroplating process including a process which is performed by increasing one of the cathode current densities and then lowering an increased cathode current density are preferable. By adopting each of these electroplating processes, for example, particularly significant effect for suppressing the Kirkendall void from being formed can be obtained when an electroplating process is performed at high speed by using the copper or copper alloy electroplating bath.

The average cathode current density in the time period from the start to the final stage is the prescribed first cathode current density, and the first cathode current density is lowered at the final stage. A cathode current density thus lowered is the second cathode current density.

The average cathode current density is calculated in accordance with the following formula (1):

Average Cathode Current Density $$=[\text{Cathode current density}]_{n1}\times([\text{Plating time}]_{n1}/\text{Total plating time})+[\text{Cathode current density}]_{n2}\times([\text{Plating time}]_{n2}/\text{Total plating time})\ldots\ldots+[\text{Cathode current density}]_{n-1}\times([\text{Plating time}]_{n-1}/\text{Total plating time})+[\text{Cathode current density}]_{n}\times([\text{Plating time}]_{n}/\text{Total plating time}) \quad (1)$$

in which the plurality of cathode current densities are n cathode current densities,

[Cathode current density]$_{n1}$ is a 1$^{st}$ cathode current density,

[Cathode current density]$_{n2}$ is a 2$^{nd}$ cathode current density, . . . . . .

[Cathode current density]$_{n-1}$ is an (n−1)$^{th}$ cathode current density,

[Cathode current density]$_{n}$ is an n$^{th}$ cathode current density,

[Plating time]$_{n1}$ is a time of plating performed at [Cathode current density]$_{n1}$,

[Plating time]$_{n2}$ is a time of plating performed at [Cathode current density]$_{n2}$, . . . . . .

[Plating time]$_{n-1}$ is a time of plating performed at [Cathode current density]$_{n-1}$, and

[Plating time]$_{n}$ is a time of plating performed at [Cathode current density]$_{n}$.

The prescribed first cathode current density is greater than or equal to 5 A/dm$^2$, preferably greater than or equal to 7 A/dm$^2$ in view of productivity of the structure.

The second cathode current density is preferably in the range from 1 A/dm$^2$ to 4 A/dm$^2$, more preferably in the range from 1.5 A/dm$^2$ to 3.0 A/dm$^2$. When the second cathode current density is lower than the lower limit, the surface layer part may be unsatisfactorily formed. When the second cathode current density is higher than the upper limit, the Kirkendall void may be unsatisfactorily suppressed from being formed. A difference between a set value of the first cathode current density and a set value of the second cathode current density is not particularly limited. The second cathode current density is at least set to a cathode current density which is lower than the first cathode current density.

In the same manner as in the first cathode current density, the second cathode current density may be a single cathode current density in an electroplating process which is performed at the single cathode current density or an average cathode current density in an electroplating process which is performed by combining a plurality of cathode current densities. The average cathode current density as the second cathode current density is calculated in accordance with the formula (1) in the same manner as in the average cathode current density as the first cathode current density.

As described above, the prescribed first cathode current density is changed to the second cathode current density which is lower than the first cathode current density, and thereby, the surface layer part of the copper plating layer or the copper alloy plating layer is formed to have a thickness in the range from 0.05 μm to 15 μm, preferably in the range from 0.5 μm to 10 μm. When the thickness of the surface layer part is less than the lower limit, the Kirkendall void is unsatisfactorily suppressed from being formed. The surface layer part having a thickness of greater than the upper limit is undesirable in view of productivity of the structure.

A thickness of the entirety of the copper plating layer or the copper alloy plating layer including the surface layer part is not particularly limited. In consideration of use of the structure as, for example, bump electrodes, the thickness is preferably in the range from about 15 μm to about 250 μm.

When the electroplating process is performed by using the copper or copper alloy electroplating bath, for example, there may be adopted various plating methods such as barrel plating, rack plating, high-speed continuous plating, rackless plating, cup plating, and dip plating. A bath temperature of the copper or copper alloy electroplating bath is not particularly limited. For example, the bath temperature is preferably higher than or equal to 0° C., more preferably in the range from about 10° C. to about 50° C.

The structure of the present invention includes the copper plating layer or the copper alloy plating layer, and the structure preferably further includes a plating layer of metal or a metal alloy other than copper adjacently to the copper plating layer or the copper alloy plating layer. The structure of the present invention further including the plating layer of metal or a metal alloy other than copper finds its extended application as, for example, bump electrodes.

The metal other than copper is not particularly limited. Examples of the metal other than copper include tin, silver, zinc, nickel, bismuth, cobalt, indium, antimony, gold, and lead. Note that as described above, any metal other than the metal producing an alloy together with copper is at least selected as the metal other than copper.

The plating layer of metal or a metal alloy other than copper is formed adjacently to the copper plating layer or the copper alloy plating layer by performing an electroplating process by using an electroplating bath of metal or a metal alloy other than copper.

The electroplating bath of metal other than copper preferably contains, for example, at least one ion-supplying compound of metal. The electroplating bath of a metal alloy other than copper preferably contains, for example, at least one ion-supplying compound of metal which is one of two or more metals constituting the metal alloy. That is, the electroplating bath of a metal alloy other than copper preferably contains at least one ion-supplying compound of each of the two or more metals. The ion-supplying compound of metal is not particularly limited and may be a soluble salt producing metal ions basically in an aqueous solution.

Examples of the soluble salt of metal, such as a soluble salt of tin, a soluble salt of silver, a soluble salt of zinc, a soluble salt of nickel, a soluble salt of bismuth, a soluble salt of cobalt, a soluble salt of indium, a soluble salt of antimony, a soluble salt of gold, or a soluble salt of lead, are the same as examples of the soluble salt which may be contained in the copper alloy electroplating bath.

A content of the ion-supplying compound of metal in the electroplating bath of metal or a metal alloy other than copper is not particularly limited. The content is preferably in the range from about 1 g/L to about 200 g/L, more preferably in the range from about 10 g/L to about 150 g/L.

A combination and a ratio of the ion-supplying compound of various metals are not particularly limited. The combination and the ratio are suitably adjusted so that the structure of the present invention including the plating layer of metal or a metal alloy other than copper adjacently to the copper plating layer or the copper alloy plating layer has a desired composition.

Among various plating layers of metal or a metal alloy other than copper, a tin plating layer or a tin alloy plating layer is preferable. The structure including the tin plating layer or the tin alloy plating layer adjacently to the copper plating layer or the copper alloy plating layer may be used, for example, as bump electrodes having further improved performances.

The electroplating bath of metal or a metal alloy other than copper can contain, for example, various additives such as an electrolyte, an accelerator, a high molecular surfactant, a leveler, a pH buffer agent, and a chelating agent in addition to the ion-supplying compound of various metals. Examples of the various additives are the same as examples of the various additives which may be contained in the copper or copper alloy electroplating bath.

A content of the various additives in the electroplating bath of metal or a metal alloy other than copper is not particularly limited. The content is suitably adjusted so that an intended plating layer of metal or a metal alloy other than copper is formed adjacently to the copper plating layer or the copper alloy plating layer.

The electroplating bath of metal or a metal alloy other than copper can be initially made by, for example, suitably combining: the one or more ion-supplying compound of metal; the various additives such as the electrolyte, the accelerator, the high molecular surfactant, the leveler, the pH buffer agent, and the chelating agent; and the like.

Also when the electroplating process is performed by using the electroplating bath of metal or a metal alloy other than copper, various plating methods may be adopted in the same manner as in the electroplating process by using the copper or copper alloy electroplating bath. Conditions for performing the electroplating process by using the electroplating bath of metal or a metal alloy other than copper are not particularly limited. For example, a cathode current density is preferably in the range from about 0.001 A/dm$^2$ to about 100 A/dm$^2$, more preferably in the range from about 0.01 A/dm$^2$ to about 40 A/dm$^2$. A bath temperature is preferably higher than or equal to 0° C., more preferably in the range from about 10° C. to about 50° C.

Thus, when the plating layer of metal or a metal alloy other than copper is formed adjacently to the copper plating layer or the copper alloy plating layer, a total thickness of the copper plating layer or the copper alloy plating layer and the plating layer of metal or a metal alloy other than copper is preferably greater than or equal to 20 μm, more preferably greater than or equal to 30 μm. When the total thickness is less than the lower limit, bonding strength between the copper plating layer or the copper alloy plating layer and the plating layer of metal or a metal alloy other than copper may be unsatisfactory. Note that the upper limit of the total thickness is not particularly limited. In consideration of use of the structure as, for example, bump electrodes, the total thickness is preferably less than or equal to 500 μm.

Note that a thickness of the plating layer of metal or a metal alloy other than copper is not particularly limited. The thickness is preferably in the range from about 5 μm to about 100 μm in consideration of bonding reliability between the copper plating layer or the copper alloy plating layer and the plating layer of metal or a metal alloy other than copper.

When the plating layer of metal or a metal alloy other than copper is not formed, reflow of copper or a copper alloy precipitated by the electroplating process is performed as necessary to form an intended structure. When the plating layer of metal or a metal alloy other than copper is formed, reflow of metal or a metal alloy other than copper precipitated by the electroplating process is performed as necessary to form an intended structure.

The structure of the present invention is used as, for example, bump electrodes. The structure may be formed on, for example, an electronic component such as a glass substrate, a silicon substrate, a sapphire substrate, a wafer, a printed wiring board, a semiconductor integrated circuit, a resistor, a variable resistor, a capacitor, a filter, an inductor, a thermistor, a quartz vibrator, a switch, a lead wire, or a solar cell.

EXAMPLES

Sequentially described below are examples of a structure α including the copper plating layer or the copper alloy plating layer of the present invention and evaluation test examples of Kirkendall void formation for a structure β including the plating layer of metal or a metal alloy other than copper adjacently to the copper plating layer or the copper alloy plating layer of the structure α.

The present invention is, however, not limited to the examples and the test examples, and may be arbitrarily modified within the scope of technical idea of the present invention.

[Structure of Present Invention (I)]

Examples according to the structure of the present invention (I) (examples in the case of the first cathode current density being a single cathode current density) and comparative examples thereof will be described.

<Example of Structure α Including Copper Plating Layer or Copper Alloy Plating Layer>

Among Examples I-1 to I-9 described below, Examples I-1 to I-8 are examples of a structure α including a copper plating layer, and Example I-9 is an example of a structure α including a copper-nickel alloy plating layer.

Comparative Examples I-1 to I-2 are examples of a structure α including a copper plating layer, and Comparative Example I-3 is an example of a structure α including a copper-nickel alloy plating layer. Comparative Examples I-1 and I-3 are blank examples in which no second cathode current density is set, and Comparative Example I-2 is a blank example in which a surface layer part has a thickness of less than 0.05 μm.

(1) Example I-1

A copper electroplating bath having the following composition was initially made. Plating conditions are also shown.

[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: 10 A/dm$^2$
Plating time: about 550 seconds
Thickness of formed copper plating layer: 20 μm
(C) After change of Cathode current density
Second cathode current density: 3 A/dm$^2$
Plating time: about 180 seconds
Thickness of formed surface layer part: 2 μm

(2) Example I-2

A copper electroplating bath having the following composition was initially made. Plating conditions are also shown.

[Composition]
Copper sulfate pentahydrate (as $Cu^{2+}$): 50 g/L
Sulfuric acid (as free acid): 100 g/L
Hydrochloric acid (as chloride ion): 50 mg/L,
Disodium 3,3'-dithiobis(1-propanesulfonate): 10 mg/L
Polyethylene glycol (average molecular weight: 1000): 100 mg/L,
[Plating Conditions]
(A) Bath temperature: 30° C.
(B) Before change of Cathode current density
First cathode current density: 5 A/dm$^2$
Plating time: about 1100 seconds
Thickness of formed copper plating layer: 20 μm (C) After change of Cathode current density
Second cathode current density: 3 A/dm$^2$
Plating time: about 180 seconds
Thickness of formed surface layer part: 2 μm (3) Example I-3

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: 15 A/dm$^2$
Plating time: about 370 seconds
Thickness of formed copper plating layer: 20 μm
(C) After change of Cathode current density
Second cathode current density: 3 A/dm$^2$
Plating time: about 180 seconds
Thickness of formed surface layer part: 2 μm (4) Example I-4

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: 10 A/dm$^2$
Plating time: about 550 seconds
Thickness of formed copper plating layer: 20 μm
(C) After change of Cathode current density
Second cathode current density: 2 A/dm$^2$
Plating time: about 270 seconds
Thickness of formed surface layer part: 2 μm (5) Example I-5

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: 10 A/dm$^2$
Plating time: about 550 seconds
Thickness of formed copper plating layer: 20 μm
(C) After change of Cathode current density
Second cathode current density: 3 A/dm$^2$
Plating time: about 90 seconds
Thickness of formed surface layer part: 1 μm (6) Example I-6

A copper electroplating bath having the following composition was initially made.
Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: 10 A/dm$^2$
Plating time: about 550 seconds
Thickness of formed copper plating layer: 20 μm
(C) After change of Cathode current density
Second cathode current density: 3 A/dm$^2$
Plating time: about 450 seconds
Thickness of formed surface layer part: 5 μm (7) Example I-7

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyoxyethylene alkyl ether (average molecular weight: 1000): 100 mg/L
[Plating Conditions]
(A) Bath temperature: 30° C.
(B) Before change of Cathode current density
First cathode current density: 10 A/dm$^2$
Plating time: about 550 seconds
Thickness of formed copper plating layer: 20 μm
(C) After change of Cathode current density
Second cathode current density: 3 A/dm$^2$
Plating time: about 180 seconds
Thickness of formed surface layer part: 2 μm (8) Example I-8

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyoxyethylene alkyl ether (average molecular weight: 1000): 100 mg/L 2-Methylimidazole: 2 mg/L

[Plating Conditions]
(A) Bath temperature: 30° C.
(B) Before change of Cathode current density
First cathode current density: 10 A/dm$^2$
Plating time: about 550 seconds
Thickness of formed copper plating layer: 20 μm
(C) After change of Cathode current density
Second cathode current density: 3 A/dm$^2$
Plating time: about 180 seconds
Thickness of formed surface layer part: 2 μm (9) Example I-9

A copper-nickel alloy electroplating bath having the following composition was initially made. Plating conditions are also shown.
[Composition]
Copper sulfate pentahydrate (as $Cu^{2+}$): 10 g/L
Nickel sulfate (as $Ni^{2+}$): 50 g/L
Sulfuric acid (as free acid): 20 g/L
Hydrochloric acid (as chloride ion): 80 mg/L
Boric acid (as pH buffer agent): 20 g/L
EDTA (as chelating agent): 120 g/L
[Plating Conditions]
(A) Bath temperature: 30° C.
(B) Before change of Cathode current density
First cathode current density: 5 A/dm$^2$
Plating time: about 1180 seconds
Thickness of formed copper-nickel alloy plating layer: 20 μm
(C) After change of Cathode current density
Second cathode current density: 2 A/dm$^2$
Plating time: about 440 seconds
Thickness of formed surface layer part: 3 μm
(D) Others
pH: 4.0 (adjusted by NaOH)

(10) Comparative Example I-1

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density (without change): 10 A/dm$^2$
Plating time: about 630 seconds
Thickness of formed entire copper plating layer: 23 μm

(11) Comparative Example I-2

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: 5 A/dm$^2$
Plating time: about 1200 seconds
Thickness of formed copper plating layer: 22 μm
(C) After change of Cathode current density
Second cathode current density: 3 A/dm$^2$
Plating time: about 20 seconds
Thickness of formed surface layer part: 0.03 μm

(12) Comparative Example I-3

A copper-nickel alloy electroplating bath having the following composition was initially made. Plating conditions are also shown.
[Composition]
Copper sulfate pentahydrate (as $Cu^{2+}$): 10 g/L
Nickel sulfate (as $Ni^{2+}$): 50 g/L
Sulfuric acid (as free acid): 20 g/L
Hydrochloric acid (as chloride ion): 80 mg/L
Boric acid (as pH buffer agent): 20 g/L
EDTA (as chelating agent): 120 g/L
[Plating Conditions]
Bath temperature: 30° C.
Cathode current density (without change): 5 A/dm$^2$
Plating time: about 1350 seconds
Thickness of formed entire copper-nickel alloy plating layer: 23 μm
pH: 4.0 (adjusted by NaOH)

<Example of Structure β Further Including Tin-Silver Alloy Plating Layer>

A tin-silver alloy plating layer was formed on each of the copper plating layers included in the structure α of Examples I-1 to I-8 and Comparative Examples I-1 to I-2 and each of the copper-nickel alloy plating layers included in the structure α of Example I-9 and Comparative Example I-3, thereby producing a structure β. Composition and plating conditions of a tin-silver alloy electroplating bath are described below.
[Composition]
Stannous methanesulfonate (as $Sn^{2+}$): 50 g/L
Silver methanesulfonate (as $Ag^{+}$): 0.3 g/L
Methanesulfonic acid: 100 g/L
Catechol (as antioxidant): 0.5 g/L
Bisphenol A polyethoxylate (EO 13 mol): 5 g/L
Alkyl naphthalene sodium sulfonate: 1 g/L
5'5-Dithiobis(1-phenyl-1H-tetrazole) (as complexing agent): 5 g/L
[Plating Conditions]
Bath temperature: 25° C.
Cathode current density: 3 A/dm$^2$
Plating time: about 800 seconds
Thickness of formed tin-silver alloy plating layer: 20 μm <Evaluation Test Example of Kirkendall Void Formation>

Reflow of the obtained structure β was performed, and the structure β was subjected to a heat process at 150° C. for 200 hours. Then, a cross section of the structure β was processed by using an ion milling apparatus, and a cross section of a Kirkendall void was observed by using a field emission scanning electron microscope (FE-SEM). From a visual field of observation, the size and the number of the Kirkendall void were confirmed, and Kirkendall void formation was evaluated based on the following evaluation criteria. The results are shown in Table 1.

[Evaluation Criteria]

◎: No Kirkendall void was observed.

○: Less than 5 Kirkendall voids each having a size smaller than 1 μm were observed, and no Kirkendall void having a size larger than or equal to 1 μm was observed.

Δ: More than or equal to 5 and less than 50 Kirkendall voids each having a size smaller than 1 μm were observed, and/or less than 5 Kirkendall voids each having a size larger than or equal to 1 μm were observed.

×: More than or equal to 50 Kirkendall voids each having a size smaller than 1 μm were observed, or more than or equal to 5 Kirkendall voids each having a size larger than or equal to 1 μm were observed.

× ×: More than or equal to 50 Kirkendall voids each having a size smaller than 1 μm were observed, and more than or equal to 5 Kirkendall voids each having a size larger than or equal to 1 μm were observed.

In Table 1, kinds of metal in each plating bath and each plating condition are also shown.

Also when the composition of the copper electroplating bath is changed as in Example I-7, Kirkendall voids can be satisfactorily suppressed from being formed in the same manner. Moreover, also when the copper electroplating bath containing a leveler is used as in Example I-8, Kirkendall voids can be satisfactorily suppressed from being formed in the same manner.

In comparison with Comparative Example I-3 in which the copper alloy plating layer was formed without changing the cathode current density as in a conventional case, satisfactory improvement in suppressing formation of Kirkendall voids was confirmed in the structure of Example I-9 in which the surface layer part of the copper alloy plating layer was formed at the second cathode current density which was lower than the first cathode current density.

[Structure of Present Invention (II)]

Examples according to the structure of the present invention (II) (examples in the case of the first cathode current density being an average cathode current density of a plurality of cathode current densities) and comparative examples thereof will be described.

TABLE 1

| | | Before change of Cathode current density | | | After change of Cathode current density | | | |
|---|---|---|---|---|---|---|---|---|
| | Kind of metal in Plating bath | First cathode current density ($A/dm^2$) | Plating time (second) | Thickness of Plating layer (μm) | Second cathode current density ($A/dm^2$) | Plating Time (second) | Thickness of Surface layer part (μm) | Kirkendall void formation |
| Ex. I-1 | Cu | 10 | 550 | 20 | 3 | 180 | 2 | ◎ |
| Ex. I-2 | Cu | 5 | 1100 | 20 | 3 | 180 | 2 | ◎ |
| Ex. I-3 | Cu | 15 | 370 | 20 | 3 | 180 | 2 | ◎ |
| Ex. I-4 | Cu | 10 | 550 | 20 | 2 | 270 | 2 | ◎ |
| Ex. I-5 | Cu | 10 | 550 | 20 | 3 | 90 | 1 | ○ |
| Ex. I-6 | Cu | 10 | 550 | 20 | 3 | 450 | 5 | ◎ |
| Ex. I-7 | Cu | 10 | 550 | 20 | 3 | 180 | 2 | ◎ |
| Ex. I-8 | Cu | 10 | 550 | 20 | 3 | 180 | 2 | ◎ |
| Ex. I-9 | Cu—Ni | 5 | 1180 | 20 | 2 | 440 | 3 | ○ |
| Com. Ex. I-1 | Cu | 10 | 630 | 23 | — | — | — | X X |
| Com. Ex. I-2 | Cu | 5 | 1200 | 22 | 3 | 20 | 0.03 | X |
| Com. Ex. I-3 | Cu—Ni | 5 | 1350 | 23 | — | — | — | X X |

The followings can be seen from Table 1.

In comparison with Comparative Example I-1 in which the copper plating layer was formed without changing the cathode current density as in a conventional case, the structure of Example I-1 in which the surface layer part of the copper plating layer was formed at the second cathode current density which was lower than the first cathode current density had no Kirkendall void, and thus significant improvement was confirmed.

In general, as a cathode current density increases in copper electroplating, the number of formed Kirkendall voids tends to increase. However, even in Example I-3 in which the first cathode current density is higher than that in Examples I-1 to I-2, forming the surface layer part of the copper plating layer at the second cathode current density which is lower than the first cathode current density enables the structure with suppressed formation of Kirkendall voids to be produced.

Also when the surface layer part of the copper plating layer, which is formed at the second cathode current density lower than the first cathode current density, is thin as in Example 1-5, certain effect for suppressing Kirkendall voids from being formed is observed. However, when the surface layer part is too thin, for example, which is thinner than 0.05 μm as in Comparative Example I-2, Kirkendall voids cannot be satisfactorily suppressed from being formed.

<Example of Structure α Including Copper Plating Layer or Copper Alloy Plating Layer>

Among Examples II-1 to II-16 described below, Examples II-1 to II-13 are examples of a structure α including a copper plating layer, Examples II-14 to II-15 are examples of a structure α including a copper-nickel alloy plating layer, and Example II-16 is an example of a structure α including a copper-silver alloy plating layer.

Comparative Examples II-1 to II-2 are examples of a structure α including a copper plating layer, Comparative Example II-3 is an example of a structure α including a copper-nickel alloy plating layer, and Comparative Example II-4 is an example of a structure α including a copper-silver alloy plating layer. Comparative Examples II-1 to II-4 are blank examples in which no second cathode current density is set.

(1) Example II-1

A copper electroplating bath having the following composition was initially made. Plating conditions are also shown.

[Composition]

Copper sulfate pentahydrate (as $Cu^{2+}$): 50 g/L

Sulfuric acid (as free acid): 100 g/L

Hydrochloric acid (as chloride ion): 50 mg/L

Disodium 3,3'-dithiobis(1-propanesulfonate): 10 mg/L

Polyethylene glycol (average molecular weight: 1000): 100 mg/L

[Plating Conditions]
(A) Bath temperature: 30° C.
(B) Before change of Cathode current density
First cathode current density: changed from 2.0 A/dm$^2$ to 15.0 A/dm$^2$
(Average cathode current density: about 14.1 A/dm$^2$)
Plating time: 27.1 seconds and 357.7 seconds respectively (Total: 384.8 seconds)
Thickness of formed copper plating layer: 20.0 μm
(C) After change of Cathode current density
Second cathode current density: 3.0 A/dm$^2$
Plating time: 271.0 seconds
Thickness of formed surface layer part: 3.0 μm (2) Example II-2

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: changed from 5.0 A/dm$^2$ to 10.0 A/dm$^2$
(Average cathode current density: about 9.9 A/dm$^2$)
Plating time: 10.8 seconds and 536.6 seconds respectively (Total: 547.4 seconds)
Thickness of formed copper plating layer: 20.0 μm
(C) After change of Cathode current density
Second cathode current density: 3.0 A/dm$^2$
Plating time: 271.0 seconds
Thickness of formed surface layer part: 3.0 μm (3) Example II-3

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: changed from 10.0 A/dm$^2$ to 20.0 A/dm$^2$
(Average cathode current density: about 19.0 A/dm$^2$)
Plating time: 27.1 seconds and 257.5 seconds respectively (Total: 284.6 seconds)
Thickness of formed copper plating layer: 20.0 μm
(C) After change of Cathode current density
Second cathode current density: 3.0 A/dm$^2$
Plating time: 271.0 seconds
Thickness of formed surface layer part: 3.0 μm (4) Example II-4

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: changed from 10.0 A/dm$^2$ to 20.0 A/dm$^2$
(Average cathode current density: about 19.0 A/dm$^2$)
Plating time: 27.1 seconds and 257.5 seconds respectively (Total: 284.6 seconds)
Thickness of formed copper plating layer: 20.0 μm
(C) After change of Cathode current density
Second cathode current density: changed from 3.0 A/dm$^2$ to 2.0 A/dm$^2$
(Average cathode current density: about 2.6 A/dm$^2$)
Plating time: 180.7 seconds and 135.5 seconds respectively (Total: 316.2 seconds)
Thickness of formed surface layer part: 3.0 μm (5) Example II-5

A copper electroplating bath having the following composition was initially made.
Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: changed from 2.0 A/dm$^2$ to 15.0 A/dm$^2$
(Average cathode current density: about 14.5 A/dm$^2$)
Plating time: 27.1 seconds and 719.1 seconds respectively (Total: 746.2 seconds)
Thickness of formed copper plating layer: 40.0 μm
(C) After change of Cathode current density
Second cathode current density: 3.0 A/dm$^2$
Plating time: 271.0 seconds
Thickness of formed surface layer part: 3.0 μm (6) Example II-6

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L

[Plating Conditions]
(A) Bath temperature: 30° C.
(B) Before change of Cathode current density
First cathode current density: changed from 2.0 A/dm$^2$ to 15.0 A/dm$^2$
(Average cathode current density: about 14.5 A/dm$^2$)
Plating time: 27.1 seconds and 719.1 seconds respectively
(Total: 746.2 seconds)
Thickness of formed copper plating layer: 40.0 μm
(C) After change of Cathode current density
Second cathode current density: 1.0 A/dm$^2$
Plating time: 271.0 seconds
Thickness of formed surface layer part: 1.0 μm (7) Example II-7

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: changed from 2.0 A/dm$^2$ to 15.0 A/dm$^2$
(Average cathode current density: about 14.5 A/dm$^2$)
Plating time: 27.1 seconds and 719.1 seconds respectively
(Total: 746.2 seconds)
Thickness of formed copper plating layer: 40.0 μm
(C) After change of Cathode current density
Second cathode current density: 0.5 A/dm$^2$
Plating time: 542.0 seconds
Thickness of formed surface layer part: 1.0 μm (8) Example II-8

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: sequentially changed from 2.0 A/dm$^2$ to 10.0 A/dm$^2$ and further to 20.0 A/dm$^2$
(Average cathode current density: about 16.8 A/dm$^2$)
Plating time: 27.1 seconds, 54.2 seconds, and 241.2 seconds respectively
(Total: 322.5 seconds)
Thickness of formed copper plating layer: 20.0 μm
(C) After change of Cathode current density
Second cathode current density: 3.0 A/dm$^2$
Plating time: 271.0 seconds
Thickness of formed surface layer part: 3.0 μm (9) Example II-9

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density First cathode current density: sequentially changed from 2.0 A/dm$^2$ to 5.0 A/dm$^2$ and further to 10.0 A/dm$^2$
(Average cathode current density: about 8.0 A/dm$^2$)
Plating time: 27.1 seconds, 222.2 seconds, and 425.5 seconds respectively
(Total: 674.8 seconds)
Thickness of formed copper plating layer: 20.0 μm
(C) After change of Cathode current density
Second cathode current density: 3.0 A/dm$^2$
Plating time: 180.0 seconds
Thickness of formed surface layer part: 2.0 μm

(10) Example II-10

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate); 10 mg/L
Polyethylene glycol (average molecular weight: 1000): 100 mg/L
[Plating Conditions]
(A) Bath temperature: 30° C.
(B) Before change of Cathode current density
First cathode current density: sequentially changed from 2.0 A/dm$^2$ to 20.0 A/dm$^2$ and further to 10.0 A/dm$^2$
(Average cathode current density: about 10.1 A/dm$^2$)
Plating time: 27.1 seconds, 27.1 seconds, and 482.4 seconds respectively
(Total: 536.6 seconds)
Thickness of formed copper plating layer: 20.0 μm
(C) After change of Cathode current density
Second cathode current density: 3.0 A/dm$^2$
Plating time: 271.0 seconds
Thickness of formed surface layer part: 3.0 μm

(11) Example II-11

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L

[Plating Conditions]
(A) Bath temperature: 30° C.
(B) Before change of Cathode current density
First cathode current density: sequentially changed from 10.0 A/dm$^2$ to 20.0 A/dm$^2$ and further to 15.0 A/dm$^2$
(Average cathode current density: about 15.3 A/dm$^2$)
Plating time: 5.4 seconds, 27.1 seconds, and 321.6 seconds respectively
(Total: 354.1 seconds)
Thickness of formed copper plating layer: 20.0 μm
(C) After change of Cathode current density
Second cathode current density: 3.0 A/dm$^2$
Plating time: 271.0 seconds
Thickness of formed surface layer part: 3.0 μm

(12) Example II-12

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density
First cathode current density: sequentially changed from 10.0 A/dm$^2$ to 5.0 A/dm$^2$ and further to 2.0 A/dm$^2$
(Average cathode current density: about 5.9 A/dm$^2$)
Plating time: 406.5 seconds, 108.4 seconds, and 406.5 seconds respectively
(Total: 921.4 seconds)
Thickness of formed copper plating layer: 20.0 μm
(C) After change of Cathode current density
Second cathode current density: 3.0 A/dm$^2$
Plating time: 271.0 seconds
Thickness of formed surface layer part: 3.0 μm

(13) Example II-13

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
(A) Bath temperature: 30° C.
(B) Before change of Cathode current density First cathode current density: sequentially changed from 10.0 A/dm$^2$ to 2.0 A/dm$^2$ and further to 20.0 A/dm$^2$
(Average cathode current density: about 7.5 A/dm$^2$)
Plating time: 406.5 seconds, 271.0 seconds, and 40.7 seconds respectively
(Total: 718.2 seconds)
Thickness of formed copper plating layer: 20.0 μm
(C) After change of Cathode current density
Second cathode current density: 3.0 A/dm$^2$
Plating time: 271.0 seconds
Thickness of formed surface layer part: 3.0 μm

(14) Example II-14

A copper-nickel alloy electroplating bath having the following composition was initially made. Plating conditions are also shown.
[Composition]
Copper sulfate pentahydrate (as $Cu^{2+}$): 2.5 g/L
Nickel sulfate (as $Ni^{2+}$): 70 g/L
Sulfuric acid (as free acid): 20 g/L
Hydrochloric acid (as chloride ion): 80 mg/L
Boric acid (as pH buffer agent): 20 g/L
EDTA (as chelating agent): 120 g/L
[Plating Conditions]
(A) Bath temperature: 30° C.
(B) Before change of Cathode current density
First cathode current density: changed from 2 A/dm$^2$ to 10 A/dm$^2$
(Average cathode current density: about 9.6 A/dm$^2$)
Plating time: 27.1 seconds and 536.6 seconds respectively
(Total: 563.7 seconds)
Thickness of formed copper-nickel alloy plating layer: 20.0 μm
(C) After change of Cathode current density
Second cathode current density: 3.0 A/dm$^2$
Plating time: 271.0 seconds
Thickness of formed surface layer part: 3.0 μm
(D) Others
pH: 4.0 (adjusted by NaOH)

(15) Example II-15

A copper-nickel alloy electroplating bath having the following composition was initially made. Plating conditions are also shown.
[Composition]
Copper sulfate pentahydrate (as $Cu^{2+}$): 2.5 g/L
Nickel sulfate (as $Ni^{2+}$): 70 g/L
Sulfuric acid (as free acid): 20 g/L
Hydrochloric acid (as chloride ion): 80 mg/L
Boric acid (as pH buffer agent): 20 g/L
EDTA (as chelating agent): 120 g/L
[Plating Conditions]
(A) Bath temperature: 30° C.
(B) Before change of Cathode current density
First cathode current density: sequentially changed from 1.0 A/dm$^2$ to 5.0 A/dm$^2$ and further to 8.0 A/dm$^2$
(Average cathode current density: about 7.0 A/dm$^2$)
Plating time: 54.2 seconds, 135.5 seconds, and 586.0 seconds respectively
(Total: 775.7 seconds)
Thickness of formed copper-nickel alloy plating layer: 20.0 μm
(C) After change of Cathode current density
Second cathode current density: 2.0 A/dm$^2$
Plating time: 440.0 seconds
Thickness of formed surface layer part: 3.0 μm
(D) Others
pH: 4.0 (adjusted by NaOH)

(16) Example II-16

A copper-silver alloy electroplating bath having the composition was initially made. Plating conditions are also shown.

[Composition]
Copper sulfate pentahydrate (as $Cu^{2+}$): 50.0 g/L
Silver methanesulfonate (as $Ag^{+}$): 0.013 g/L
Sulfuric acid (as free acid): 100 g/L
Hydrochloric acid (as chloride ion): 50 mg/L
DL-methionine (as chelating agent): 5 g/L
Polyethylene glycol (average molecular weight: 1000): 1000 mg/L
[Plating Conditions]
(A) Bath temperature: 30° C.
(B) Before change of Cathode current density
First cathode current density: changed from 2.0 A/dm$^2$ to 10.0 A/dm$^2$
(Average cathode current density: about 9.6 A/dm$^2$)
Plating time: 27.1 seconds and 536.6 seconds respectively (Total: 563.7 seconds)
Thickness of formed copper-silver alloy plating layer: 20.0 μm
(C) After change of Cathode current density
Second cathode current density: 3.0 A/dm$^2$
Plating time: 271.0 seconds
Thickness of formed surface layer part: 3.0 μm

(17) Comparative Example II-1

A copper electroplating bath having the following composition was initially made. Plating conditions are also shown.

[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density (without change): 15.0 A/dm$^2$
Plating time: 361.3 seconds
Thickness of formed entire copper plating layer: 20.0 μm

(18) Comparative Example II-2

A copper electroplating bath having the following composition was initially made. Plating conditions are also shown.

[Composition]
Copper sulfate pentahydrate (as $Cu^{2+}$): 50 g/L
Sulfuric acid (as free acid): 100 g/L
Hydrochloric acid (as chloride ion): 50 mg/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density (without change): 10.0 A/dm$^2$
Plating time: 542.0 seconds
Thickness of formed entire copper plating layer: 20.0 μm

(19) Comparative Example II-3

A copper-nickel alloy electroplating bath having the following composition was initially made. Plating conditions are also shown.

[Composition]
Copper sulfate pentahydrate (as $Cu^{2+}$): 10 g/L
Nickel sulfate (as $Ni^{2+}$): 50 g/L
Sulfuric acid (as free acid): 20 g/L
Hydrochloric acid (as chloride ion): 80 mg/L
Boric acid (as pH buffer agent): 20 g/L
EDTA (as chelating agent): 120 g/L
[Plating Conditions]
Bath temperature: 30° C.
Cathode current density (without change): 10.0 A/dm$^2$
Plating time: about 542.0 seconds
Thickness of formed entire copper-nickel alloy plating layer: 20.0 μm
pH: 4.0 (adjusted by NaOH)

(20) Comparative Example II-4

A copper-silver alloy electroplating bath having the composition was initially made. Plating conditions are also shown.

[Composition]
Copper sulfate pentahydrate (as $Cu^{2+}$): 50.0 g/L
Silver methanesulfonate (as $Ag^{+}$): 0.013 g/L
Sulfuric acid (as free acid): 100 g/L
Hydrochloric acid (as chloride ion): 50 mg/L
DL-methionine (as chelating agent): 5 g/L
Polyethylene glycol (average molecular weight: 1000): 1000 mg/L
[Plating Conditions]
Bath temperature: 30° C.
Cathode current density (without change): 10.0 A/dm$^2$
Plating time: about 542.0 seconds
Thickness of formed entire copper-silver alloy plating layer: 20.0 μm <Example of Structure β Further Including Tin-Silver Alloy Plating Layer>

A tin-silver alloy plating layer was formed on each of the copper plating layers included in the structure α of Examples II-1 to II-13 and Comparative Examples II-1 to II-2, each of the copper-nickel alloy plating layers included in the structure α of Examples II-14 to II-15 and Comparative Example II-3, and each of the copper-silver alloy plating layers included in the structure α of Example II-16 and Comparative Example II-4, thereby producing a structure β. Composition and plating conditions of a tin-silver alloy electroplating bath are described below.

[Composition]
Stannous methanesulfonate (as $Sn^{2+}$): 50 g/L
Silver methanesulfonate (as $Ag^{+}$): 0.3 g/L
Methanesulfonic acid: 100 g/L
Catechol (as antioxidant): 0.5 g/L
Bisphenol A polyethoxylate (EO 13 mol): 5 g/L
Alkyl naphthalene sodium sulfonate: 1 g/L
5'5-Dithiobis(1-phenyl-1H-tetrazole) (as complexing agent): 5 g/L
[Plating Conditions]
Bath temperature: 25° C.
Cathode current density: 3 A/dm$^2$
Plating time: about 800 seconds
Thickness of formed tin-silver alloy plating layer: 20 μm <Evaluation Test Example of Kirkendall Void Formation>

Reflow of the obtained structure β was performed, and the structure β was subjected to a heat process at 180° C. for 300 hours. Then, a cross section of the structure β was processed by using the ion milling apparatus, and a cross section of a Kirkendall void was observed by using the field emission scanning electron microscope (FE-SEM). From a visual field of observation, the size and the number of the Kirkendall void were confirmed, and Kirkendall void formation was evaluated based on the following evaluation criteria. The results are shown in Table 2-D.

[Evaluation Criteria]

◎: No Kirkendall void was observed.

○: Less than 5 Kirkendall voids each having a size smaller than 1 μm were observed, and no Kirkendall void having a size larger than or equal to 1 μm was observed.

Δ: More than or equal to 5 and less than 50 Kirkendall voids each having a size smaller than 1 μm were observed, and/or less than 5 Kirkendall voids each having a size larger than or equal to 1 μm were observed.

×: More than or equal to 50 Kirkendall voids each having a size smaller than 1 μm were observed, or more than or equal to 5 Kirkendall voids each having a size larger than or equal to 1 μm were observed.

× ×: More than or equal to 50 Kirkendall voids each having a size smaller than 1 μm were observed, and more than or equal to 5 Kirkendall voids each having a size larger than or equal to 1 μm were observed.

In Tables 2-A to 2-D, kinds of metal in each plating bath and each plating condition are also shown.

TABLE 2-B-continued

| | Before change of Cathode current density (First cathode current density) | | |
|---|---|---|---|
| | Average current density ($A/dm^2$) | Total plating time (second) | Total thickness of Plating layer (μm) |
| Ex. II-7 | 14.5 | 746.2 | 40.0 |
| Ex. II-8 | 16.8 | 322.5 | 20.0 |
| Ex. II-9 | 8.0 | 674.8 | 20.0 |
| Ex. II-10 | 10.1 | 536.6 | 20.0 |
| Ex. II-11 | 15.3 | 354.1 | 20.0 |
| Ex. II-12 | 5.9 | 921.4 | 20.0 |
| Ex. II-13 | 7.5 | 718.2 | 20.0 |
| Ex. II-14 | 9.6 | 563.7 | 20.0 |
| Ex. II-15 | 7.0 | 775.7 | 20.0 |
| Ex. II-16 | 9.6 | 563.7 | 20.0 |
| Com. Ex. II-1 | 15.0 | 361.3 | 20.0 |
| Com. Ex. II-2 | 10.0 | 542.0 | 20.0 |
| Com. Ex. II-3 | 10.0 | 542.0 | 20.0 |
| Com. Ex. II-4 | 10.0 | 542.0 | 20.0 |

TABLE 2

Table 2-A

| | Kind of metal in Plating bath | Before change of Cathode current density (First cathode current density) | | | | | | | | |
|---|---|---|---|---|---|---|---|---|---|---|
| | | First stage | | | Second stage | | | Third stage | | |
| | | Current density (A/dm2) | Plating time (second) | Thickness of Plating layer (μm) | Current density (A/dm2) | Plating time (second) | Thickness of Plating layer (μm) | Current density (A/dm2) | Plating time (second) | Thickness of Plating layer (μm) |
| Ex. II-1 | Cu | 2.0 | 27.1 | 0.2 | 15.0 | 357.7 | 19.8 | — | — | — |
| Ex. II-2 | Cu | 5.0 | 10.8 | 0.2 | 10.0 | 536.6 | 19.8 | — | — | — |
| Ex. II-3 | Cu | 10.0 | 27.1 | 1.0 | 20.0 | 257.5 | 19.0 | — | — | — |
| Ex. II-4 | Cu | 10.0 | 27.1 | 1.0 | 20.0 | 257.5 | 19.0 | — | — | — |
| Ex. II-5 | Cu | 2.0 | 27.1 | 0.2 | 15.0 | 719.1 | 39.8 | — | — | — |
| Ex. II-6 | Cu | 2.0 | 27.1 | 0.2 | 15.0 | 719.1 | 39.8 | — | — | — |
| Ex. II-7 | Cu | 2.0 | 27.1 | 0.2 | 15.0 | 719.1 | 39.8 | — | — | — |
| Ex. II-8 | Cu | 2.0 | 27.1 | 0.2 | 10.0 | 54.2 | 2.0 | 20.0 | 241.2 | 17.8 |
| Ex. II-9 | Cu | 2.0 | 27.1 | 0.2 | 5.0 | 222.2 | 4.1 | 10.0 | 425.5 | 15.7 |
| Ex. II-10 | Cu | 2.0 | 27.1 | 0.2 | 20.0 | 27.1 | 2.0 | 10.0 | 482.4 | 17.8 |
| Ex. II-11 | Cu | 10.0 | 5.4 | 0.2 | 20.0 | 27.1 | 2.0 | 15.0 | 321.6 | 17.8 |
| Ex. II-12 | Cu | 10.0 | 406.5 | 15.0 | 5.0 | 108.4 | 2.0 | 2.0 | 406.5 | 3.0 |
| Ex. II-13 | Cu | 10.0 | 406.5 | 15.0 | 2.0 | 271.0 | 2.0 | 20.0 | 40.7 | 3.0 |
| Ex. II-14 | Cu—Ni | 2.0 | 27.1 | 0.2 | 10.0 | 536.6 | 19.8 | — | — | — |
| Ex. II-15 | Cu—Ni | 1.0 | 54.2 | 0.2 | 5.0 | 135.5 | 2.5 | 8.0 | 586.0 | 17.3 |
| Ex. II-16 | Cu—Ag | 2.0 | 27.1 | 0.2 | 10.0 | 536.6 | 19.8 | — | — | — |
| Com. Ex. II-1 | Cu | 15.0 | 361.3 | 20.0 | — | — | — | — | — | — |
| Com. Ex. II-2 | Cu | 10.0 | 542.0 | 20.0 | — | — | — | — | — | — |
| Com. Ex. 11-3 | Cu—Ni | 10.0 | 542.0 | 20.0 | — | — | — | — | — | — |
| Com. Ex. II-4 | Cu—Ag | 10.0 | 542.0 | 20.0 | — | — | — | — | — | — |

TABLE 2-B

| | Before change of Cathode current density (First cathode current density) | | |
|---|---|---|---|
| | Average current density ($A/dm^2$) | Total plating time (second) | Total thickness of Plating layer (μm) |
| Ex. II-1 | 14.1 | 384.8 | 20.0 |
| Ex. II-2 | 9.9 | 547.4 | 20.0 |
| Ex. II-3 | 19.0 | 284.6 | 20.0 |
| Ex. II-4 | 19.0 | 284.6 | 20.0 |
| Ex. II-5 | 14.5 | 746.2 | 40.0 |
| Ex. II-6 | 14.5 | 746.2 | 40.0 |

TABLE 4

Table 2-C

| | After change of Cathode current density (Second cathode current density) | | | | | |
|---|---|---|---|---|---|---|
| | First stage | | | Second stage | | |
| | Current density (A/dm2) | Plating time (second) | Thickness of Surface layer part (μm) | Current density (A/dm2) | Plating time (second) | Thickness of Surface layer part (μm) |
| Ex. II-1 | 3.0 | 271.0 | 3.0 | — | — | — |
| Ex. II-2 | 3.0 | 271.0 | 3.0 | — | — | — |

TABLE 4-continued

Table 2-C

| | After change of Cathode current density (Second cathode current density) | | | | | |
|---|---|---|---|---|---|---|
| | First stage | | | Second stage | | |
| | Current density (A/dm2) | Plating time (second) | Thickness of Surface layer part (μm) | Current density (A/dm2) | Plating time (second) | Thickness of Surface layer part (μm) |
| Ex. II-3 | 3.0 | 271.0 | 3.0 | — | — | — |
| Ex. II-4 | 3.0 | 180.7 | 2.0 | 2.0 | 135.5 | 1.0 |
| Ex. I1-5 | 3.0 | 271.0 | 3.0 | — | — | — |
| Ex. II-6 | 1.0 | 271.0 | 1.0 | — | — | — |
| Ex. II-7 | 0.5 | 542.0 | 1.0 | — | — | — |
| Ex. II-8 | 3.0 | 271.0 | 3.0 | — | — | — |
| Ex. II-9 | 3.0 | 180.0 | 2.0 | — | — | — |
| Ex. II-10 | 3.0 | 271.0 | 3.0 | — | — | — |
| Ex. II-11 | 3.0 | 271.0 | 3.0 | — | — | — |
| Ex. II-12 | 3.0 | 271.0 | 3.0 | — | — | — |
| Ex. II-13 | 3.0 | 271.0 | 3.0 | — | — | — |
| Ex. II-14 | 3.0 | 271.0 | 3.0 | — | — | — |
| Ex. II-15 | 2.0 | 440.0 | 3.0 | — | — | — |
| Ex. II-16 | 3.0 | 271.0 | 3.0 | — | — | — |
| Com. Ex. II-1 | — | — | — | — | — | — |
| Com. Ex. II-2 | — | — | — | — | — | — |
| Com. Ex. II-3 | — | — | — | — | — | — |
| Com. Ex. II-4 | — | — | — | — | — | — |

TABLE 2-D

| | After change of Cathode current density (Second cathode current density) | | | |
|---|---|---|---|---|
| | Average current density ($A/dm^2$) | Total plating time (second) | Total thickness of Surface layer part (μm) | Kirkendall void formation |
| Ex. II-1 | 3.0 | 271.0 | 3.0 | ◎ |
| Ex. II-2 | 3.0 | 271.0 | 3.0 | ◎ |
| Ex. II-3 | 3.0 | 271.0 | 3.0 | ◎ |
| Ex. II-4 | 2.6 | 316.2 | 3.0 | ◎ |
| Ex. II-5 | 3.0 | 271.0 | 3.0 | ◎ |
| Ex. II-6 | 1.0 | 271.0 | 1.0 | ○ |
| Ex. II-7 | 0.5 | 542.0 | 1.0 | ○ |
| Ex. II-8 | 3.0 | 271.0 | 3.0 | ◎ |
| Ex. II-9 | 3.0 | 180.0 | 2.0 | ◎ |
| Ex. II-10 | 3.0 | 271.0 | 3.0 | ◎ |
| Ex. II-11 | 3.0 | 271.0 | 3.0 | ◎ |
| Ex. II-12 | 3.0 | 271.0 | 3.0 | ◎ |
| Ex. II-13 | 3.0 | 271.0 | 3.0 | ◎ |
| Ex. II-14 | 3.0 | 271.0 | 3.0 | ○ |
| Ex. II-15 | 2.0 | 440.0 | 3.0 | ○ |
| Ex. II-16 | 3.0 | 271.0 | 3.0 | ○ |
| Com. Ex. II-1 | — | — | — | X X |
| Com. Ex. II-2 | — | — | — | X X |
| Com. Ex. II-3 | — | — | — | X X |
| Com. Ex. II-4 | — | — | — | X X |

The followings can be seen from Tables 2-A to 2-D.

In comparison with Comparative Examples II-1 to II-2 in which the copper plating layer was formed without changing the cathode current density as in a conventional case, satisfactorily suppressed formation of Kirkendall voids was confirmed in each of the structures of Examples II-1 to II-13 in which the surface layer part of the copper plating layer was formed by changing the first cathode current density which was the average cathode current density of the plurality of cathode current densities to the second cathode current density which was lower than the first cathode current density.

Not only when the first cathode current density is the average cathode current density of a plurality of cathode current densities consisting of one cathode current density and the other cathode current density increased in the course of the process as in Examples II-1 to II-3, but also when the second cathode current density is also the average cathode current density of the plurality of cathode current densities in addition to the first cathode current density as in Example II-4, no Kirkendall void is formed, and significant improvement is observed.

Also when a thick copper plating layer is formed by setting the first cathode current density as the average cathode current density of the plurality of cathode current densities consisting of one cathode current density and the other cathode current density increased in the course of the process as in Example II-5, no Kirkendall void is formed, and significant improvement is observed.

Also when a thick copper plating layer is formed by setting the first cathode current density as the average cathode current density of the plurality of cathode current densities consisting of one cathode current density and the other cathode current density increased in the course of the process and a thin surface layer part is formed at the second cathode current density which is lower than the first cathode current density as in Examples II-6 to II-7, satisfactorily suppressed formation of Kirkendall voids is observed.

Also when the first cathode current density is set as the average cathode current density of a plurality of cathode current densities consisting of one cathode current density and the other cathode current densities sequentially increased in the course of the process as in Examples II-8 to II-9, when the first cathode current density is set as the average cathode current density of a plurality of cathode current densities consisting of one cathode current density and the other cathode current densities increased and then lowered in the course of the process as in Examples II-10 to II-11, when the first cathode current density is set as the average cathode current density of a plurality of cathode current densities consisting of one cathode current density and the other cathode current densities sequentially lowered in the course of the process as in Example II-12, and when the first cathode current density is set as the average cathode current density of a plurality of cathode current densities consisting of one cathode current density and the other cathode current densities lowered and then increased in the course of the process as in Example II-13, no Kirkendall void is formed, and significant improvement is observed.

In comparison with Comparative Example II-3 in which the copper-nickel alloy plating layer was formed without changing the cathode current density as in a conventional case, satisfactorily suppressed formation of Kirkendall voids was confirmed in each of the structures of Examples II-14 to II-15 in which the surface layer part of the copper-nickel alloy plating layer was formed by changing the first cathode current density which was the average cathode current density of the plurality of cathode current densities to the second cathode current density which was lower than the first cathode current density. In comparison with Comparative Example II-4 in which the copper-silver alloy plating layer was formed without changing the cathode current density as in a conventional case, satisfactorily suppressed formation of Kirkendall voids was confirmed in the structure of Example II-16 in which the surface layer part of the copper-silver alloy plating layer was formed by changing the first cathode current density which was the average cathode current density of the plurality of cathode current densities to the second cathode current density which was lower than the first cathode current density.

Also when the first cathode current density is set as the average cathode current density of the plurality of cathode current densities consisting of one cathode current density and the other cathode current densities sequentially increased in the course of the process as in Example II-15, satisfactorily suppressed formation of Kirkendall voids is observed.

Note that although the structures of Examples II-1 to II-16 are subjected to a heat process under further stringent conditions, namely, at 180° C. for 300 hours, the Kirkendall void is satisfactorily suppressed from being formed.

The structure including the copper plating layer or the copper alloy plating layer of the present invention can be formed, for example, as bump electrodes in various electronic components, and can impart high reliability to the electronic components.

What is claimed is:

1. A structure including a copper plating layer or a copper alloy plating layer, wherein the copper plating layer or the copper alloy plating layer is a plating layer which is formed by:

performing an electroplating process at a prescribed first cathode current density by using a copper or copper alloy electroplating bath; and then completing the electroplating process after the prescribed first cathode current density is changed to a second cathode current density which is lower than the prescribed first cathode current density, the prescribed first cathode current density is a single cathode current density in the electroplating process which is performed at the single cathode current density until the first cathode current density is changed to the second cathode current density, the prescribed first cathode current density is greater than or equal to 5 A/dm$^2$, a layer which is formed by changing the prescribed first cathode current density to the second cathode current density is a surface layer part of the copper plating layer or the copper alloy plating layer, and the surface layer part has a thickness of 0.05 μm to 15 μm, the structure further including a plating layer of metal or a metal alloy other than copper adjacently to the copper plating layer or the copper alloy plating layer, wherein:

after a heat process for the structure at 150° C. for 200 hours, at a bonding interface between: the copper plating layer or the copper alloy plating layer; and the plating layer of metal or a metal alloy other than copper, no Kirkendall void is observed, or less than 5 Kirkendall voids each having a size smaller than 1 μm are observed, and no Kirkendall void having a size larger than or equal to 1 μm is observed.

2. A structure including a copper plating layer or a copper alloy plating layer, wherein the copper plating layer or the copper alloy plating layer is a plating layer which is formed by:

performing an electroplating process at a prescribed first cathode current density by using a copper or copper alloy electroplating bath; and then completing the electroplating process after the prescribed first cathode current density is changed to a second cathode current density which is lower than the prescribed first cathode current density, the prescribed first cathode current density is an average cathode current density in the electroplating process which is performed by combining a plurality of cathode current densities until the first cathode current density is changed to the second cathode current density, the average cathode current density is calculated in accordance with a formula (1):

Average Cathode Current Density $$=[\text{Cathode current density}]_{n1}\times([\text{Plating time}]_{n1}/\text{Total plating time})+[\text{Cathode current density}]_{n2}\times([\text{Plating time}]_{n2}/\text{Total plating time})\ldots\ldots+[\text{Cathode current density}]_{n-1}\times([\text{Plating time}]_{n-1}/\text{Total plating time})+[\text{Cathode current density}]_{n}\times([\text{Plating time}]_{n}/\text{Total plating time}) \quad (1)$$

in which the plurality of cathode current densities are n cathode current densities, $[\text{Cathode current density}]_{n1}$ is a 1$^{st}$ cathode current density, $[\text{Cathode current density}]_{n2}$ is a 2$^{nd}$ cathode current density, . . . . . .

$[\text{Cathode current density}]_{n-1}$ is an (n−1)$^{th}$ cathode current density, $[\text{Cathode current density}]_{n}$ is an n$^{th}$ cathode current density, $[\text{Plating time}]_{n1}$ is a time of plating performed at $[\text{Cathode current density}]_{n1}$, $[\text{Plating time}]_{n2}$ is a time of plating performed at $[\text{Cathode current density}]_{n2}$, . . . . . .

$[\text{Plating time}]_{n-1}$ is a time of plating performed at $[\text{Cathode current density}]_{n-1}$, and $[\text{Plating time}]_{n}$ is a time of plating performed at $[\text{Cathode current density}]_{n}$, the prescribed first cathode current density is greater than or equal to 5 A/dm$^2$, a layer which is formed by changing the prescribed first cathode current density to the second cathode current density is a surface layer part of the copper plating layer or the copper alloy plating layer, and the surface layer part has a thickness of 0.05 μm to 15 μm, the structure further including a plating layer of metal or a metal alloy other than copper adjacently to the copper plating layer or the copper alloy plating layer, wherein:

after a heat process for the structure at 180° C. for 300 hours, at a bonding interface between: the copper plating layer or the copper alloy plating layer; and the plating layer of metal or a metal alloy other than copper, no Kirkendall void is observed, or less than 5 Kirkendall voids each having a size smaller than 1 μm are observed, and no Kirkendall void having a size larger than or equal to 1 μm is observed.

3. The structure according to claim 2, wherein:

in a time period from a start of the electroplating process which is performed by combining the plurality of cathode current densities to a final stage in which the copper plating layer or the copper alloy plating layer is formed, the electroplating process which is performed by combining the plurality of cathode current densities is:

an electroplating process which is performed by sequentially increasing the cathode current densities; or an electroplating process including a process which is performed by increasing one of the cathode current densities and then, lowering an increased cathode current density.

4. The structure according to claim 1, wherein a total thickness of: the copper plating layer or the copper alloy plating layer; and the plating layer of metal or a metal alloy other than copper is in a range from 20 μm to 500 μm.

5. The structure according to claim 1, wherein the structure is a bump electrode.

6. The structure according to claim 2, wherein a total thickness of: the copper plating layer or the copper alloy plating layer; and the plating layer of metal or a metal alloy other than copper is in a range from 20 μm to 500 μm.

7. The structure according to claim 2, wherein the structure is a bump electrode.

* * * * *